US007975670B2

(12) United States Patent
Ito

(10) Patent No.: US 7,975,670 B2
(45) Date of Patent: Jul. 12, 2011

(54) CONTROL UNIT AND CONTROL METHOD FOR TORQUE-DEMAND-TYPE INTERNAL COMBUSTION ENGINE

(75) Inventor: Masahiro Ito, Toyota (JP)

(73) Assignee: Toyota Jidosha Kabushiki Kaisha, Toyota (JP)

( * ) Notice: Subject to any disclaimer, the term of this patent is extended or adjusted under 35 U.S.C. 154(b) by 151 days.

(21) Appl. No.: 12/310,540

(22) PCT Filed: Mar. 18, 2008

(86) PCT No.: PCT/IB2008/000637

§ 371 (c)(1),
(2), (4) Date: Feb. 27, 2009

(87) PCT Pub. No.: WO2008/114121

PCT Pub. Date: Sep. 25, 2008

(65) Prior Publication Data

US 2010/0236520 A1 Sep. 23, 2010

(30) Foreign Application Priority Data

Mar. 19, 2007 (JP) ..... 2007-070639

(51) Int. Cl.
*F02P 5/15* (2006.01)
*F02M 3/00* (2006.01)

(52) U.S. Cl. ..... 123/339.11; 123/339.1

(58) Field of Classification Search ..... 123/339.1, 123/339.11, 339.14, 339.19, 399, 403, 406.19, 123/674; 701/101, 54
See application file for complete search history.

(56) References Cited

U.S. PATENT DOCUMENTS

| | | | | |
|---|---|---|---|---|
| 5,619,967 | A | 4/1997 | Streib | |
| 6,109,236 | A * | 8/2000 | Takahashi et al. | 123/339.19 |
| 2005/0056250 | A1 | 3/2005 | Stroh | |
| 2005/0224048 | A1 | 10/2005 | Hoshino et al. | |
| 2005/0235743 | A1 | 10/2005 | Stempnik et al. | |
| 2005/0274355 | A1 | 12/2005 | Watanabe | |
| 2008/0066718 | A1 | 3/2008 | Sato et al. | |

FOREIGN PATENT DOCUMENTS

| | | | |
|---|---|---|---|
| DE | 195 01 299 | A1 | 7/1996 |
| EP | 1 342 898 | A2 | 9/2003 |
| EP | 1 387 065 | A2 | 2/2004 |
| EP | 1 512 856 | A2 | 3/2005 |
| EP | 1 780 390 | A1 | 5/2007 |
| JP | A-7-247873 | | 9/1995 |
| JP | A-11-22525 | | 1/1999 |
| JP | A-11-93736 | | 4/1999 |
| JP | A-11-280514 | | 10/1999 |
| JP | A-2000-512713 | | 9/2000 |

(Continued)

*Primary Examiner* — Mahmoud Gimie
(74) *Attorney, Agent, or Firm* — Oliff & Berridge, PLC

(57) ABSTRACT

An ECU executes a program including: detecting the engine speed NE and the current KL (S1010, S1020) when the ISC learning control is started ("YES" in S1000); changing the ignition efficiency so that the NE and the output torque are kept unchanged even when the throttle valve opening amount changes (S1030); calculating the target torque by multiplying the ISC target torque by the ignition efficiency (S1040); calculating the target KL based on the target torque, the NE and the MBT (S1050); calculating the throttle valve opening amount based on the target KL (S1060); calculating the target ignition timing based on the NE, the current KL and the target torque (S1070); and controlling an engine using the calculated throttle valve opening amount, ignition timing and fuel injection amount (S1080).

22 Claims, 4 Drawing Sheets

FOREIGN PATENT DOCUMENTS

| | | |
|---|---|---|
| JP | A-2001-98985 | 4/2001 |
| JP | A-2006-177301 | 7/2006 |
| JP | A-2007-92711 | 4/2007 |
| WO | WO 2006/016423 A1 | 2/2006 |

* cited by examiner

CONTROL UNIT AND CONTROL METHOD FOR TORQUE-DEMAND-TYPE INTERNAL COMBUSTION ENGINE

BACKGROUND OF THE INVENTION

1. Field of the Invention

The invention relates generally to a control unit and control method for an internal combustion engine, which executes an ISC (Idle Speed Control) learning control, and, more specifically to an ISC learning control executed over a torque-demand-type internal combustion engine.

2. Description of the Related Art

Usually, an idle speed control (ISC) is executed over an engine. The idle speed control is executed to maintain the idle speed of the engine at a constant speed. More specifically, an air passage, through which the air bypasses a throttle valve of the engine, is formed, and the flow passage area of the air passage is adjusted by an actuator to adjust the flow rate of the air (air-fuel mixture), whereby the idle speed is controlled. An idle speed control unit executes a feedback control to bring the idle speed closer to a target value. Thus, the engine speed is maintained substantially constant.

The air flow rate that is required to maintain the idle speed of the engine at a constant speed in the feedback control varies depending on various factors such as the individual difference and the temporal change. Therefore, a so-called learning control for storing the results of feedback is executed. Usually, the initial learned value of the idle-time air flow-rate is set to a value high enough to reliably avoid engine stalling. When the learning control has not been completed, the idle speed control is executed using the initial value.

Japanese Patent Application Publication No. 2006-177301 (JP-A-2006-177301) describes an idle speed control unit for an internal combustion engine, which prevents erroneous learning in the idle speed control. The idle speed control unit adjusts the intake air amount based on the ISC correction amount to control the engine speed when the engine is idling. The ISC correction amount includes a feedback term for adjusting the engine speed to the target value, an ISC learned value that increases or decreases to bring the feedback term into a predetermined range when the internal combustion engine is warm, a cold-time correction term that increases or decreases when the engine is cold, and a cold/warm time correction term that increases or decreases both when the engine is cold and when it is warm. Only when the internal combustion engine is cold, the intake air density correction is executed on only the cold-time correction term so that the cold-time correction term increases as the density of the intake air decreases.

With this idle speed control unit for an internal combustion engine, when the internal combustion engine is warm, the ISC learned value is adjusted so that the feedback term falls within the predetermined range. When the feedback term falls within the predetermined range, determination of the ISC learned value is completed. When the internal combustion engine is warm, the ISC learned value thus determined is a value that corresponds to the density of the intake air (intake air density), and the cold/warm-time correction term is adjusted to a value corresponding to the intake air density based on the ISC learned value. This adjustment compensates for the deviation of intake air amount from the appropriate value due to a difference in the intake air density. When the internal combustion engine is cold, the intake air density correction is executed on only the cold-time correction term so that the cold-time correction term increases as the intake air density decreases. This correction compensates for the deviation of the intake air amount from the appropriate value due to the difference in the intake air density. The intake air density correction is not executed on the cold/warm-time correction term when the internal combustion engine is warm. Therefore, it is possible to avoid an unnecessary intake air density correction executed on the cold/warm-time correction term and erroneous learning of the ISC learned value caused by determining the ISC learned value at the same time as the intake air density correction when the engine is warm.

In the ISC learning control, the difference between the average characteristic that indicates the relationship between "throttle valve opening amount and flow rate", which is stored in an engine ECU (Electronic Control Unit), and the current characteristic that indicates the relationship between "throttle valve opening amount detected by throttle sensor and flow rate detected by airflow meter" is learned. The manner in which the current flow characteristic changes (e.g. variation in the individual difference) differs from the manner in which the average flow characteristic changes. The line indicating the current characteristic deviates from the line indicating the average characteristic in parallel. In addition, the inclination of the line indicating the current characteristic differs from the inclination of the line indicating the average characteristic. Therefore, the deviation varies depending on the throttle valve opening amount. Accordingly, it is preferable to execute the ISC learning control at various throttle valve opening amounts.

However, the actual ISC learning control is executed in a stable idle state (the throttle valve opening amount is kept unchanged and therefore the engine speed is kept unchanged). That is, the learning control is executed only in a considerably small throttle valve opening amount range (in the idle state). This is because, if the throttle valve opening amount is changed in the stable idle state, the engine speed changes, which makes it difficult to execute the ISC learning control. This means that, if only the throttle valve opening amount is changed in such stable idle state, the engine speed changes.

However, JP-A-2006-177301 does not describe that the learning control over the throttle valve flow characteristic is executed in a broader range by intentionally changing the throttle valve opening amount in the stable idle state.

SUMMARY OF THE INVENTION

The invention provides a control unit and control method for a torque-demand-type internal combustion engine suitable for an ISC learning control, which makes it possible to execute the ISC learning control in a broader throttle valve opening amount range.

Examples of a control unit for a torque-demand-type internal combustion engine described below include a control unit that is used when a torque required of an engine is achieved by an engine control system in the case where a target torque required by an entire vehicle including the engine and a power train system needs to be achieved.

A first aspect of the invention relates to a control unit for a torque-demand-type internal combustion engine. The control unit includes: a learning control unit that executes learning of the flow characteristic of a throttle valve, which adjusts the amount of air taken in the internal combustion engine, when the state of the internal combustion engine satisfies a predetermined ISC learning control start condition; and a control unit that executes a torque-demand control using the relationship established among at least the intake efficiency of the internal combustion engine, the torque output from the internal combustion engine and the engine speed. The control unit includes: an intake efficiency control unit that changes the intake efficiency of the internal combustion engine so as to change the opening amount of the throttle valve while the flow characteristic of the throttle valve is being learned; and an ignition timing control unit that changes the ignition timing of the internal combustion engine when the intake efficiency of the internal combustion engine is being changed, thereby controlling the ignition timing of the internal combustion engine so that the engine speed is kept unchanged.

According to the first aspect of the invention, for example, when the internal combustion engine is brought into a stable idle state, it is determined that the ISC learning control start condition is satisfied, and the flow characteristic of the throttle valve, which adjusts the amount of air taken in the internal combustion engine, is learned. At this time, the throttle valve opening amount is intentionally changed to the extent possible. However, if the throttle valve opening amount is changed by a large amount, the engine speed and the torque output from the internal combustion engine change. As a result, the ISC learning control cannot be executed. Therefore, when the throttle valve opening amount is changed (when the intake efficiency of the internal combustion engine is changed), the ignition timing of the internal combustion engine is changed. For example, when the throttle valve opening amount is increased by a large amount, the ignition timing is retarded to decrease the ignition efficiency. In this way, the engine speed and the torque output from the internal combustion engine are kept unchanged even if the throttle valve opening amount is changed. A torque-demand control is employed in a control for increasing the throttle valve opening amount by a large amount (control for increasing the intake efficiency) and a control for retarding the ignition timing (control for decreasing the ignition efficiency). As a result, it is possible to provide the control unit for a torque-demand-type internal combustion engine suitable for the ISC learning control, which makes it possible to execute the ISC learning control in a broader throttle valve opening amount range.

A second aspect of the invention relates to the control unit according to the first aspect of the invention, in which the ignition timing control unit retards the ignition timing to decrease an ignition efficiency corresponding to the ignition timing when the intake efficiency of the internal combustion engine is increased, until the ignition efficiency reaches a limit efficiency.

According to the second aspect of the invention, when the throttle valve opening amount is increased by a large amount (when the intake efficiency of the internal combustion engine is increased), the ignition timing is retarded by executing the torque-demand control. Therefore, the ignition efficiency is decreased. As a result, even when the throttle valve opening amount is changed, the engine speed and the torque output from the internal combustion engine are kept unchanged.

A third aspect of the invention relates to the control unit according to the first aspect of the invention, in which the ignition timing control unit advances the ignition timing to an ignition timing at the start time of an ISC learning control in order to increase the ignition efficiency corresponding to the ignition timing when the intake efficiency of the internal combustion engine is decreased, after the ignition efficiency reaches the limit efficiency.

According to the third aspect of the invention, after the throttle valve opening amount is increased by a large amount and the ignition efficiency reaches the limit efficiency, the ignition timing is advanced to increase the ignition efficiency by executing the torque-demand control when the throttle valve opening amount is decreased (when the intake efficiency of the internal combustion engine is decreased). Therefore, even when the throttle valve opening amount is changed, the engine speed and the torque output from the internal combustion engine are kept unchanged.

A fourth aspect of the invention relates to the ignition timing control unit according to any one of first to third aspects of the invention, in which the ignition timing control unit calculates the ignition timing using an actual intake efficiency.

According to the fourth aspect of the invention, the ignition timing is calculated using the actual intake efficiency when the ignition timing is retarded or advanced by executing the torque-demand control using the relationship established among the intake efficiency, the torque output from the internal combustion engine and the engine speed. Therefore, it is possible to accurately control the ignition efficiency.

A fifth aspect of the invention relates to a control method for a torque-demand-type internal combustion engine. According to the control method, learning of a flow characteristic of a throttle valve, which adjusts an amount of air taken in the internal combustion engine, is executed when a state of the internal combustion engine satisfies a predetermined ISC learning control start condition; and a control is executed using the relationship established among at least the intake efficiency of the internal combustion engine, the torque output from the internal combustion engine and the engine speed. In the control, the intake efficiency of the internal combustion engine is changed so as to change the opening amount of the throttle valve while the flow characteristic of the throttle valve is being learned, and the ignition timing of the internal combustion engine is changed when the intake efficiency of the internal combustion engine is being changed, whereby the ignition timing of the internal combustion engine is controlled so that the engine speed is kept unchanged.

BRIEF DESCRIPTION OF THE DRAWINGS

The foregoing and further features and advantages of the invention will become apparent from the following description of an example embodiment with reference to the accompanying drawings, wherein the same or corresponding portions will be denoted by the same reference numerals and wherein.

DETAILED DESCRIPTION OF THE EMBODIMENT

Figure 1:
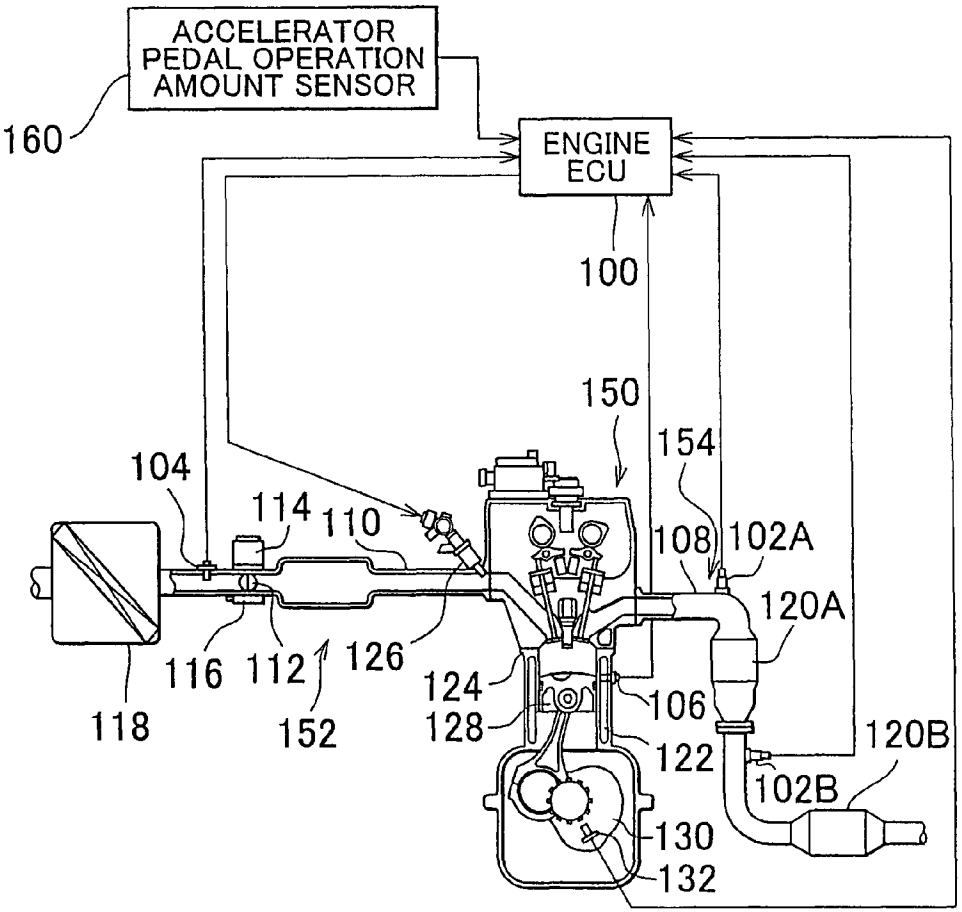
FIG. 1 is a control block diagram for a vehicle provided with a control unit according to an embodiment of the invention.

Hereafter, an embodiment of the invention will be described with reference to the accompanying drawings. In the description below, the same components will be denoted by the same reference numerals. Because the names and the functions of the components having the same reference numerals are also the same, the detailed description thereof will be provided only once below. The following description will be provided on the assumption that a torque-demand control is executed over an engine.

In the embodiment of the invention, when the torque-demand control is executed over the engine, a learning control is executed over the flow characteristic of a throttle valve in a broader throttle valve opening amount range. Therefore, the torque-demand control will be described below.

In a vehicle provided with an engine of which the output torque is controlled independently of an operation of an accelerator pedal performed by a driver, and an automatic transmission, a "drive power control" may be executed. In the drive power control, a target drive torque, which takes a positive value or a negative value and which is calculated based on the amount by which the accelerator pedal is operated by the driver (hereinafter, referred to as "accelerator pedal operation amount" where appropriate), the operating conditions of the vehicle, etc. is achieved by controlling the engine torque and the gear ratio of the automatic transmission. Controls such as a "drive power requiring control", a "drive power demand control", and a "torque-demand control" are similar to the drive power control.

A torque-demand engine control unit calculates a target torque which should be output from an engine based on the accelerator pedal operation amount, the engine speed, and the external load, and controls the fuel injection amount and the air supply amount based on the target torque. This torque-demand engine control unit actually calculates a target generation torque by adding loss load torques, such as a friction torque, that are lost in the engine and a power train system to the required output torque. The engine control unit then controls the fuel injection amount and the air supply amount so that the target generation torque is achieved. The torque-demand engine control unit improves the driving performance, for example, makes it possible to always maintain a constant driving feel, by adjusting the engine torque, which is a physical quantity that directly exerts an influence on the vehicle control, to a reference value. That is, the torque required by the entire vehicle including the engine and the power train system and the target torque are matched with each other by controlling the engine and an automatic transmission (including a lock-up clutch).

In addition, if the torque-demand control method is employed only for the engine (that is, only the engine is a control target and the automatic transmission is not a control target), only the engine is controlled to output a target torque required of the engine.

That is, the throttle valve opening amount, the ignition timing, and the fuel injection amount, at which the target torque is achieved, are calculated based on, the relationship among the engine speed NE, the intake efficiency KL (=amount (mass flow) of air taken into cylinder/maximum amount (mass flow) of air that can be taken in cylinder), the ignition timing SA (hereinafter, ignition timing will be referred to as "SA" (Spark Advance) where appropriate), the air-fuel ratio A/F (stoichiometric air-fuel ratio may be used), and the torque. Namely, in the engine torque-demand control described above, an engine ECU (Electronic Control Unit) calculates a target engine torque and controls the throttle valve opening amount, the ignition timing and the fuel injection amount to achieve the target torque.

As shown in FIG. 1, a vehicle provided with a control unit according to the embodiment of the invention includes an engine 150, an intake system 152, an exhaust system 154, and an engine ECU 100. Although the engine 150 is a port-injection gasoline engine, the engine 150 may be provided with a direct-injection fuel injector that directly injects fuel into a cylinder instead of or in addition to a port injector.

The intake system 152 includes an intake passage 110, an air cleaner 118, an airflow meter 104, a throttle motor 114, a throttle valve 112, and a throttle position sensor 116.

The air taken in from the air cleaner 118 flows into the engine 150 through the intake passage 110. The throttle valve 112 is provided in a middle portion of the intake passage 110. The throttle valve 112 is opened and closed in accordance with the operation of the throttle motor 114. The opening amount of the throttle valve 112 is detected by the throttle position sensor 116. The airflow meter 104, which detects the intake air amount, is provided in the intake passage at a position between the air cleaner 118 and the throttle valve 112. The airflow meter 104 transmits an intake-air amount signal that indicates the intake air amount Q to the engine ECU 100.

The engine 150 includes a coolant passage 122, a cylinder block 124, an injector 126, pistons 128, a crankshaft 130, a coolant temperature sensor 106, and a crank position sensor 132.

A predetermined number of cylinders are formed within the cylinder block 124, and the pistons 128 are provided in the respective cylinders. The mixture of the fuel injected from the injector 126 and the intake air is introduced into a combustion chamber formed above the piston 128 through the intake passage 110, and ignited by a spark plug (not shown). When combustion takes place, the piston 128 is pushed down. The reciprocation of the piston 128 is converted into the rotation of the crankshaft 130 via a crank mechanism. The engine ECU 100 detects the rotational speed NE of the engine 150 based on a signal from the crank position sensor 132.

A coolant is circulated through the coolant passage 122 formed within the cylinder block 124 in accordance with the operation of a water pump (not shown). The coolant in the coolant passage 122 flows to a radiator (not shown) connected to the coolant passage 122 and cooled by a cooling fan (not shown). The coolant temperature sensor 106, which detects the temperature THW of the coolant in the coolant passage 122 (engine coolant temperature THW), is provided on the coolant passage 122. The coolant temperature sensor 106 transmits a signal that indicates the detected engine coolant temperature THW to the engine ECU 100.

The exhaust system 154 includes an exhaust passage 108, a first air-fuel ratio sensor 102A, a second air-fuel ratio sensor 102B, a first three-way catalytic converter 120A, and a second three-way catalytic converter 120B. The first air-fuel ratio sensor 102A is provided at a position upstream of the first three-way catalytic converter 120A, and the second air-fuel sensor 102B is provided at a position downstream of the first three-way catalytic converter 120A (upstream of the second three-way catalytic converter 120B). Instead of providing two three-way catalytic converters, only one three-way catalytic converter may be provided.

The exhaust passage 108 that is connected to an exhaust port of the engine 150 is connected to the first three-way catalytic converter 120A and the second three-way catalytic converter 120B. That is, the exhaust gas generated due to the combustion of the air-fuel mixture, which takes place in the combustion chamber of the engine 150, first flows into the first three-way catalytic converter 120A. HC and CO contained in the exhaust gas introduced into the first three-way catalytic converter 120A are oxidized in the first three-way catalytic converter 120A. NOx contained in the exhaust gas introduced into the first three-way catalytic converter 120A is reduced in the first three-way catalytic converter 120A. The first three-way catalytic converter 120A is provided near the engine 150. Even when the engine 150 is started while it is cold, the temperature of the first three-way catalytic converter 120A is promptly increased and therefore the three-way catalytic converter 120A exhibits its catalytic function promptly.

Then, the exhaust gas is delivered from the first three-way catalytic converter 120A to the second three-way catalytic converter 120B in order to remove the NOx. The first three-way catalytic converter 120A and the second three-way catalytic converter 120B basically have the same structure and function.

The first air-fuel ratio sensor 102A, which is provided at a position upstream of the first three-way catalytic converter 120A, and the second air-fuel ratio sensor 102B, which is provided at a position downstream of the first three-way catalytic converter 120A and upstream of the second three-way catalytic converter 120B, detect the oxygen concentration in the exhaust gas that will pass through the first three-way catalytic converter 120A and the exhaust gas that will pas through the second three-way catalytic converter 120B, respectively. It is possible to detect the ratio between the fuel and the air that are contained in the exhaust gas, that is, the air-fuel ratio, by detecting the oxygen concentration in the exhaust gas.

Each of the first air-fuel ratio sensor 102A and the second air-fuel ratio sensor 102B generates an electric current having a magnitude that corresponds to the oxygen concentration in the exhaust gas. The current value is converted into, for example, the pressure value, and a signal that indicates the pressure value is transmitted to the engine ECU 100. Therefore, it is possible to detect the air-fuel ratio of the exhaust gas upstream of the first three-way catalytic converter 120A based on the signal output from the first air-fuel ratio sensor 102A. Also, it is possible to detect the air-fuel ratio of the exhaust gas upstream of the second three-way catalytic converter 120B based on the signal output from the second air-fuel ratio sensor 102B. Each of the first air-fuel ratio sensor 102A and the second air-fuel ratio sensor 102B generates a voltage of, for example, approximately 0.1 V when the air-fuel ratio is higher than the stoichiometric air-fuel ratio, and generates a voltage of, for example, approximately 0.9 V when the air-fuel ratio is lower than the stoichiometric air-fuel ratio. The values obtained by converting these voltage values into the air-fuel ratios and the threshold value of the air-fuel ratio are compared with each other, and the engine ECU 100 controls the air-fuel ratio based on the result of comparison.

The first three-way catalytic converter 120A and the second three-way catalytic converter 120B each have a function of reducing NOx while oxidizing HC and CO when the air-fuel ratio is substantially equal to the stoichiometric air-fuel ratio, that is, a function of removing HC, CO and NOx at the same time. In the first three-way catalytic converter 120A and the second catalytic converter 120B, the oxidizing action becomes active but the reducing action becomes inactive when the air-fuel ratio is higher than the stoichiometric air-fuel ratio and the exhaust gas contains a large amount of oxygen, whereas the reducing action becomes active but the oxidizing action becomes inactive when the air-fuel ratio is lower than the stoichiometric air-fuel ratio and the exhaust gas contains a small amount of oxygen. Therefore, it is not possible to appropriately remove HC, CO and NOx at the same time.

An accelerator pedal operation amount sensor is connected to the engine ECU 100, and detects the operation amount of the accelerator pedal, which is operated by a driver.

The engine ECU 100 executes a torque-demand control over the engine 150. The engine ECU 100 calculates the throttle valve opening amount, the ignition timing and the fuel injection amount, at which the target torque is achieved, based on the relationship among the engine speed NE, the intake efficiency KL, the ignition timing SA, the air-fuel ratio A/F (stoichiometric air-fuel ratio is used in this case), and the torque. Then, the engine ECU 100 controls the opening amount of the throttle valve 112, the ignition timing, and the amount of fuel injected from the injector 126 (more specifically, the engine ECU 100 controls the fuel injection duration to control the fuel injection amount in a region (fuel injection amount limit region) in which a linear relationship is established between the fuel injection duration and the fuel injection amount).

In the engine torque demand control, the engine ECU 100 calculates the target torque that should be generated by the engine, and controls the throttle valve opening amount, the ignition timing and the fuel injection amount to achieve the target torque. In addition, the engine ECU 100 calculates the throttle valve opening amount based on the target intake efficiency KL, which is calculated based on the target torque, and controls the throttle valve 112 to achieve the calculated throttle valve opening amount. Under this control, the opening amount of the throttle valve 112 is adjusted and the intake efficiency KL changes. The current intake efficiency KL is detected, and the ignition timing is controlled based on the current intake efficiency KL.

According to the embodiment of the invention, although the throttle valve opening amount is intentionally changed in order to execute the ISC learning control in a broader range of the opening amount of the throttle valve 112, the engine speed NE and the engine torque are maintained constant by changing the ignition timing to the extent possible. The engine torque-demand control is employed to execute this control.

Figure 2:
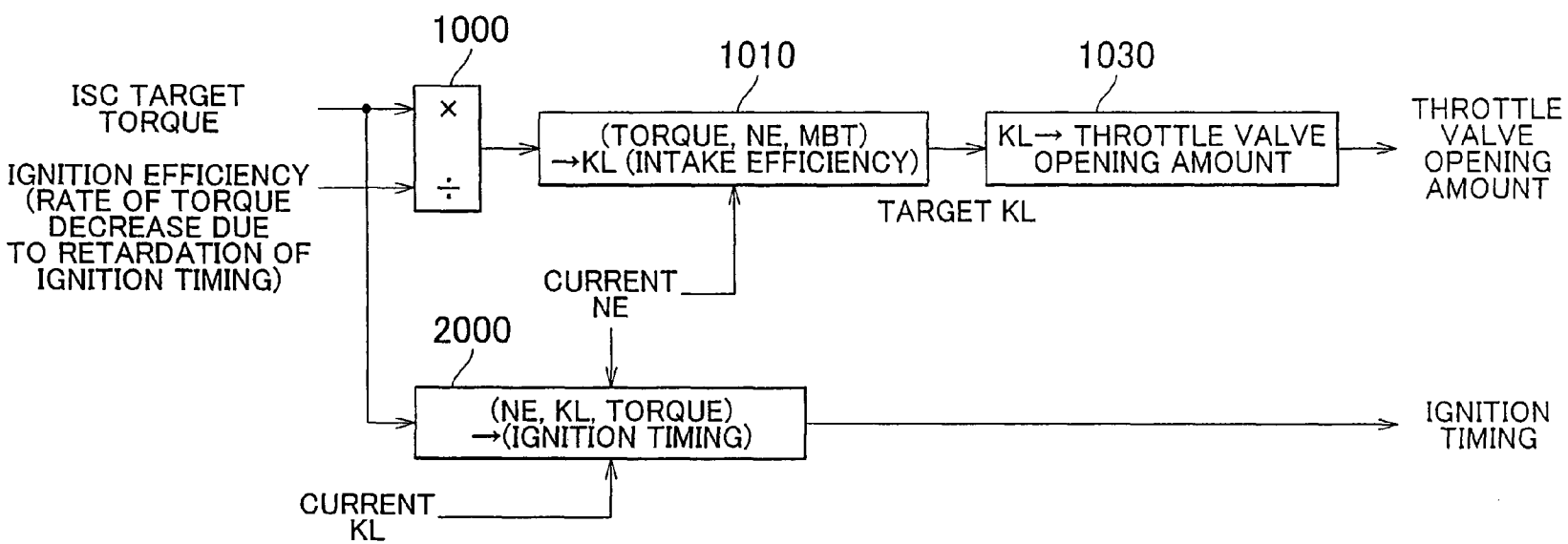
FIG. 2 is a control block diagram for the control unit according to the embodiment of the invention.

FIG. 2 is a control block diagram for the control unit according to the embodiment of the invention. As shown in FIG. 2, the control unit (implemented by the engine ECU 100) controls the engine 150 so that the torque output from the engine 150 and the rotational speed NE of the engine 150 are kept unchanged by changing the ignition timing even if the opening amount of the throttle valve 112 is changed to actually execute the ISC learning control. At this time, the torque-demand control is executed. A description will be provided on the torque-demand control for keeping the torque output from the engine 150 and the rotational speed NE of the engine 150 unchanged even if the opening amount of the throttle valve 112 is changed to execute the ISC learning control.

The following control is executed in order to keep the torque output from the engine 150 and the rotational speed NE of the engine 150 unchanged. A computing unit 1000 calculates a torque (target torque) by multiplying the target torque used in an ISC (Idle Speed Control) (hereinafter, referred to as "ISC target torque" where appropriate) by the ignition efficiency that is a rate of torque decrease due to retardation of the ignition timing. When the throttle valve 112 is opened by a larger amount, the target intake efficiency (hereinafter, referred to as "target KL" where appropriate) needs to be increased. In order to increase the target KL with the ISC target torque kept constant, the ignition timing is retarded to decrease the torque decrease rate (decrease the ignition efficiency). A KL calculating unit 1010 calculates the target KL based on the calculated target torque, the engine speed NE (current engine speed) and the MBT (Minimum spark advance for Best Torque). A throttle valve opening amount calculating unit 1030 calculates the opening amount of the throttle valve 112 (hereinafter, referred to as "throttle valve opening amount" where appropriate) based on the target KL.

The current intake efficiency KL (hereinafter, referred to as "current KL") is detected, and an ignition timing calculating unit 2000 calculates the ignition timing based on the engine speed NE (current engine speed), the current KL and the target torque described above.

The control unit according to the embodiment of the invention may be implemented by hardware formed mainly of a structure including a digital circuit or an analog circuit, or software formed mainly of a CPU (Central Processing Unit) and a memory included in the engine ECU 100 and a program that is read from the memory and executed by the CPU. In general, implementing the control unit using hardware offers advantages in the operation speed, and implementing the control unit using software offers advantages in design change. The description below will be provided on the assumption that the control unit is implemented by software.

Figure 3:
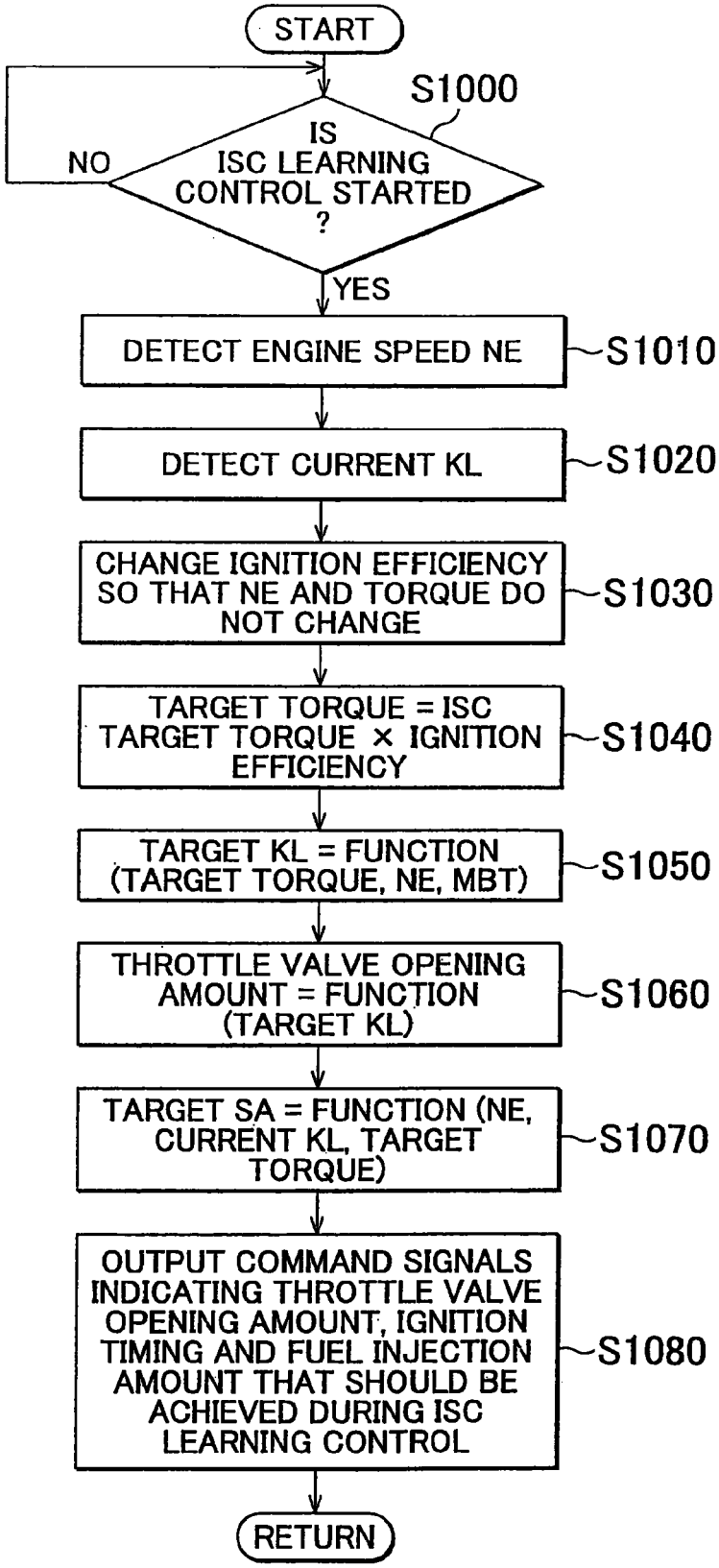
FIG. 3 is a flowchart showing the control routine of an ISC learning control executed by an engine ECU in FIG. 1.

FIG. 3 is a flowchart showing the control routine of the ISC learning control executed by the engine ECU 100, which serves as the control unit according to the embodiment of the invention. The control routine is a subroutine program that is periodically executed at predetermined time intervals.

In step (hereinafter, referred to as "S") 1000, the engine ECU 100 determines whether the condition for starting the ISC learning control has been satisfied. The engine ECU 100 determines that the condition for starting the ISC learning control has been satisfied when the engine 150 enters a stable idle state (when the idle state comes out of the transient state and delay in control response is eliminated). When it is determined that the condition for starting the ISC learning control has been satisfied ("YES" in S1000), S1010 is executed. On the other hand, when it is determined that the condition for starting the ISC learning control has not been satisfied ("NO" in S1000), S1000 is executed again. Because this routine is the subroutine program, if a negative determination is made in S1000, the process may return to the main routine.

In S1010, the engine ECU 100 detects the engine speed NE. In S1020, the engine ECU 100 detects the current intake efficiency (current KL).

In S1030, the engine ECU 100 changes the ignition efficiency so that the engine speed NE and the engine torque are kept unchanged. At this time, the ignition efficiency is decreased (the ignition timing is retarded) until the ignition efficiency reaches the limit efficiency. When the ignition efficiency reaches the limit efficiency, the ignition efficiency is increased to the original ignition efficiency (the ignition timing is advanced to the original ignition timing).

In S1040, the engine ECU 100 calculates the target torque by multiplying the ISC target torque by the ignition efficiency. In S1050, the engine ECU 100 calculates the target KL using the function of which the variables are the target torque, the engine speed NE and the MBT.

In S1060, the engine ECU 100 calculates the opening amount of the throttle valve 112 using the function of which the variable is the target KL. In S1070, the engine ECU 100 calculates the target ignition timing (hereinafter, referred to as "target SA" where appropriate) using the function of which the variables are the engine speed NE, the current KL, and the target torque.

In S1080, the engine ECU 100 transmits command signals that indicate the throttle valve opening amount, the ignition timing and the fuel injection amount which should be achieved during the ISC learning control to a controller for controlling the opening amount of the throttle valve 112, an ignition timing controller, and a fuel injection amount controller, respectively. With this process, even when the ignition timing is changed, the torque output from the engine 150 and the engine speed are kept unchanged.

Hereafter, a description will be provided on the operating state of the engine 150 during the ISC learning control executed by the control unit (ECU) according to the embodiment of the invention. The control unit has the above-described configuration and executes the above-described flowchart.

In the case where the driver does not depress the accelerator pedal and the vehicle is at a standstill, when the idle state continues for a predetermined length of time, it is determined that the condition for starting the ISC learning control has been satisfied ("YES" in S1000). At time t1 in FIG. 4, it is determined that the condition for starting the ISC learning control has been satisfied.

In order to execute the ISC learning control in a broader throttle valve opening amount range from time t1, the control unit according to the embodiment of the invention 1) increases the target KL to increase the throttle valve opening amount, 2) decreases the ignition efficiency so that the engine torque and the engine speed NE are kept unchanged even if the target KL increases, and 3) retards the ignition timing to decrease the ignition efficiency. When the ignition timing reaches the retardation limit (the lower limit of the ignition timing range in which inconveniences such as a misfire do not occur), the ignition timing is advanced. At this time, the ISC learning control is executed while decreasing the throttle valve opening amount.

Figure 4:
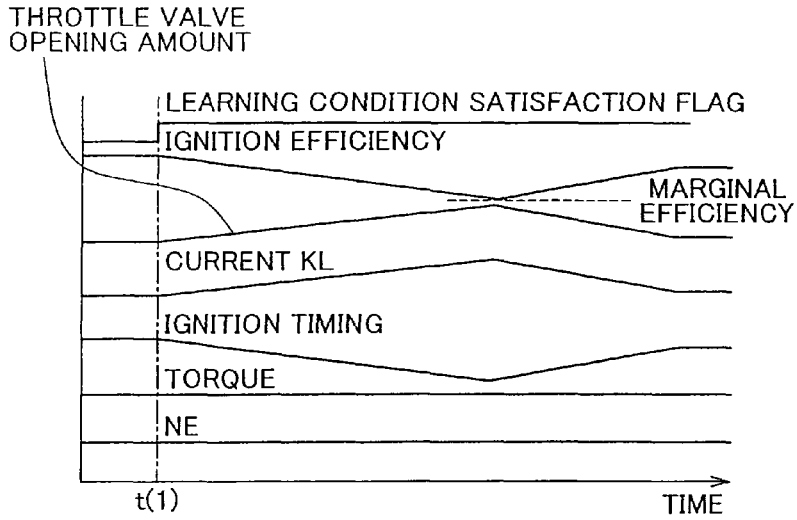
FIG. 4 is a timing chart showing the state during the ISC learning control.

Namely, as shown in FIG. 4, when the ISC learning control is executed ("YES" in S1000), the opening amount of the throttle valve 112 is changed. The engine 150 is in the stable idle state when the ISC learning control is started. Therefore, first, the ignition efficiency is changed (decreased) so that the engine speed and the engine torque are kept unchanged even if the opening amount of the throttle valve 112 is increased (S1030).

The target torque is calculated by multiplying the ISC target torque by the ignition efficiency (S1040), and the target KL is calculated based on the target torque, the engine speed NE and the MBT (S1050). In addition, the opening amount of the throttle valve 112 is calculated based on the target KL (S1060), and the target SA is calculated based on the engine speed, the current KL and the target torque (S1070). The fuel injection amount is calculated by multiplying the current KL by the conversion coefficient.

Command signals that indicate the calculated throttle valve opening amount, ignition timing and fuel injection amount are output to the controller for controlling the opening amount of the throttle valve 112, the ignition timing controller and the fuel injection amount controller, respectively.

This process is periodically executed from when the ISC learning control is started until when the ignition efficiency reaches the limit efficiency of the ignition efficiency range in which a misfire does not occur. The ISC learning control is executed with the throttle valve 112 opened by a larger amount. At this time, although the target KL increases, the ignition timing is retarded and the ignition efficiency is decreased. Therefore, the engine torque and the engine speed NE are kept unchanged.

When the ignition efficiency reaches the limit efficiency after the ISC learning control is started, the ISC learning control is executed when the throttle valve 112 is controlled to be closed. At this time, although the target KL decreases, the ignition timing is advanced and the ignition efficiency increases. Therefore, the engine torque and the engine speed NE are kept unchanged.

As described above, the control unit according to the embodiment of the invention intentionally changes the opening amount of the throttle valve 112 when executing the ISC learning control. Therefore, it is possible to learn the flow characteristic of the throttle valve 112 in a broader range of the opening amount of the throttle valve 112. At this time, A)

until the ignition efficiency reaches the limit efficiency, the ISC learning control is executed in the state in which the opening amount of the throttle valve 112 is increased while the ignition timing is retarded to decrease the ignition efficiency, and B) after the ignition efficiency reaches the limit efficiency, the ISC learning control is executed in the state in which the opening amount of the throttle valve 112 is decreased while the ignition timing is advanced to increase the ignition efficiency in order to avoid occurrence of inconveniences such as a misfire.

Even when the ISC learning control is being executed, because the ignition efficiency (ignition timing) is changed, the engine torque and the engine speed NE are kept unchanged. As a result, it is possible to maintain the engine torque and the engine speed NE constant, and to execute the ISC learning control accurately.

First Modified Example

Hereafter, a first modified example of the embodiment of the invention will be described. The first modified example has the following features in addition to the features of the embodiment of the invention.

After the condition for starting the ISC learning condition is satisfied, the ignition timing is gradually retarded to an ignition timing that is determined based on the combustion limit and/or the vibration limit. After the ignition timing is retarded to the value corresponding to the limit efficiency, the ignition timing is then gradually advanced to a value corresponding to the original ignition efficiency to bring the state into the original stable idle state.

The ignition timing may be retarded/advanced and the opening amount of the throttle valve 112 may be changed in a stepwise manner. In addition, the combustion limit and the vibration limit are usually calculated experimentally or empirically.

According to the first modified example, the ISC learning control is executed in a broader throttle valve opening amount range safely (in the state in which combustion takes place in an appropriate manner and undesirable vibrations are avoided).

Second Modified Example

Hereafter, a second modified example of the embodiment of the invention will be described. The second modified example has the following features in addition to the features of the embodiment of the invention.

The above-described ISC learning control is executed only once during one trip (from when the engine 150 is started until when the engine 150 is stopped). The ISC learning control is executed in the following manner. Until the ignition efficiency reaches the limit efficiency, the ignition timing is retarded to decrease the ignition efficiency, whereby the engine torque is kept unchanged in the process of increasing the opening amount of the throttle valve 112. After the ignition efficiency reaches the limit efficiency, the ignition timing is advanced to increase the ignition efficiency, whereby the engine torque is kept unchanged in the process of decreasing the opening amount of the throttle valve 112 to the original opening amount.

The ISC learning control is executed once when the engine enters a stable idle state for the first time after the engine is warmed. Whether the engine has entered the stable idle state for the first time after the engine is warmed is determined based on, for example, whether the engine coolant temperature has increased sufficiently.

According to the second modified example, the driver does not recognize easily that the ISC learning control is being executed.

Third Modified Example

Figure 5:
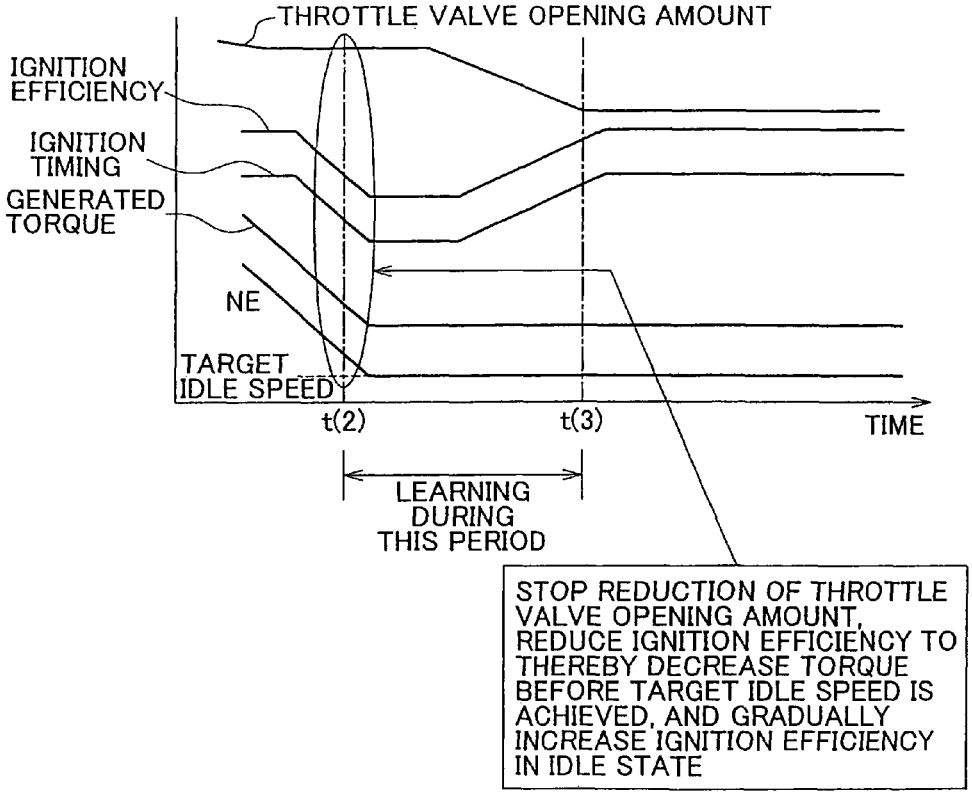
FIG. 5 is a timing chart according to a modified example of the embodiment of the invention.

Hereafter, a third modified example of the embodiment of the invention will be described with reference to FIG. 5. The third modified example has the following features in addition to the features of the above-described embodiment.

When the driver releases the accelerator pedal while the vehicle is traveling, the engine 150 is brought to the idle state. In the process of shifting the engine 150 into the idle state, before the rotational speed of the engine 150 reaches the target idle speed (immediately after time t2 in FIG. 5), closing of the throttle valve 112 is stopped and the ignition efficiency is decreased. In this way, the torque output from the engine 150 is decreased. After the engine 150 is shifted to the idle state, the ignition timing is gradually changed to the original ignition timing (the ignition efficiency is increased).

According to the third modified example, the driver does not recognize easily that the ISC learning control is being executed.

The embodiment of the invention that has been disclosed in the specification is to be considered in all respects as illustrative and not restrictive. The technical scope of the invention is defined by claims, and all changes which come within the meaning and range of equivalency of the claims are therefore intended to be embraced therein.

The invention claimed is:

1. A control unit for a torque-demand-type internal combustion engine, comprising:

a learning control unit that executes learning of a flow characteristic of a throttle valve, which adjusts an amount of air taken in the internal combustion engine, when a state of the internal combustion engine satisfies a predetermined ISC learning control start condition; and a control unit that executes a torque-demand control using a relationship established among at least an intake efficiency of the internal combustion engine, a torque output from the internal combustion engine and an engine speed, wherein the control unit includes an intake efficiency control unit that changes the intake efficiency of the internal combustion engine so as to change an opening amount of the throttle valve while the flow characteristic of the throttle valve is being learned, and an ignition timing control unit that changes an ignition timing of the internal combustion engine when the intake efficiency of the internal combustion engine is being changed, thereby controlling the ignition timing of the internal combustion engine so that the engine speed is kept unchanged.

2. The control unit according to claim 1, wherein the ignition timing control unit retards the ignition timing to decrease an ignition efficiency corresponding to the ignition timing when the intake efficiency of the internal combustion engine is increased, until the ignition efficiency reaches a limit efficiency.

3. The control unit according to claim 2, wherein the ignition timing control unit stops closing of the throttle valve and retards the ignition timing, thereby keeping the engine speed unchanged, before the engine speed reaches a target idle speed in a process of shifting the internal combustion engine into an idle state.

4. The control unit according to claim 2, wherein the ignition timing control unit retards the ignition timing to an ignition timing, which is determined based on at least one of a combustion limit and a vibration limit, gradually or in a stepwise manner after the ISC learning control start condition is satisfied.

5. The control unit according to claim 1, wherein the ignition timing control unit advances the ignition timing to an ignition timing at a start time of an ISC learning control in order to increase an ignition efficiency corresponding to the ignition timing when the intake efficiency of the internal combustion engine is decreased, after the ignition efficiency reaches a limit efficiency.

6. The control unit according to claim 5, wherein the ignition timing control unit advances the ignition timing gradually after the internal combustion engine is shifted into an idle state.

7. The control unit according to claim 5, wherein the ignition timing control unit advances the ignition timing to the ignition timing at the start time of the ISC learning control gradually or in a stepwise manner to shift the internal combustion engine into a stable idle state, after the ignition timing is retarded to an ignition timing, which is determined based on at least one of a combustion limit and a vibration limit.

8. The control unit according to claim 1, wherein the ignition timing control unit calculates the ignition timing using an actual intake efficiency.

9. The control unit according to claim 1, wherein the learning control unit executes an ISC learning control only once in a period from when the internal combustion engine is started until when the internal combustion engine is stopped.

10. The control unit according to claim 9, wherein the learning control unit executes the ISC learning control when the internal combustion engine enters a stable idle state for a first time after the internal combustion engine is sufficiently warmed.

11. The control unit according to claim 1, wherein it is determined that the predetermined ISC learning control start condition has been satisfied when the internal combustion engine has been in an idle state for a predetermined length of time.

12. A control method for a torque-demand-type internal combustion engine, characterized by comprising:

executes learning of a flow characteristic of a throttle valve, which adjusts an amount of air taken in the internal combustion engine, when a state of the internal combustion engine satisfies a predetermined ISC learning control start condition; and executing a control using a relationship established among at least an intake efficiency of the internal combustion engine, a torque output from the internal combustion engine and an engine speed, wherein, in the control, the intake efficiency of the internal combustion engine is changed so as to change an opening amount of the throttle valve while the flow characteristic of the throttle valve is being learned, and an ignition timing of the internal combustion engine is changed when the intake efficiency of the internal combustion engine is being changed, whereby the ignition timing of the internal combustion engine is controlled so that the engine speed is kept unchanged.

13. The control method according to claim 12, wherein the ignition timing is retarded to decrease an ignition efficiency corresponding to the ignition timing when the intake efficiency of the internal combustion engine is increased, until the ignition efficiency reaches a limit efficiency.

14. The control method according to claim 13, wherein closing of the throttle valve is stopped and the ignition timing is retarded, whereby the engine speed is kept unchanged, before the engine speed reaches a target idle speed in a process of shifting the internal combustion engine into an idle state.

15. The control method according to claim 13, wherein the ignition timing is retarded to an ignition timing, which is determined based on at least one of a combustion limit and a vibration limit, gradually or in a stepwise manner after the ISC learning control start condition is satisfied.

16. The control method according to claim 12, wherein the ignition timing is advanced to an ignition timing at a start time of an ISC learning control in order to increase an ignition efficiency corresponding to the ignition timing when the intake efficiency of the internal combustion engine is decreased, after the ignition efficiency reaches a limit efficiency.

17. The control method according to claim 16, wherein the ignition timing is advanced gradually after the internal combustion engine is shifted into an idle state.

18. The control method according to claim 16, wherein the ignition timing is advanced to the ignition timing at the start time of the ISC learning control gradually or in a stepwise manner to shift the internal combustion engine into a stable idle state, after the ignition timing is retarded to an ignition timing, which is determined based on at least one of a combustion limit and a vibration limit.

19. The control method according to claim 12, wherein the ignition timing is calculated using an actual intake efficiency.

20. The control method according to claim 12, wherein an ISC learning control is executed only once in a period from when the internal combustion engine is started until when the internal combustion engine is stopped.

21. The control method according to claim 20, wherein the ISC learning control is executed when the internal combustion engine enters a stable idle state for a first time after the internal combustion engine is sufficiently warmed.

22. The control method according to claim 12, wherein it is determined that the predetermined ISC learning control start condition has been satisfied when the internal combustion engine has been in an idle state for a predetermined length of time.

* * * * *